US009759143B2

(12) United States Patent
Ooiwa

(10) Patent No.: US 9,759,143 B2
(45) Date of Patent: Sep. 12, 2017

(54) EVAPORATION FUEL PROCESSING APPARATUS

(71) Applicant: DENSO CORPORATION, Kariya, Aichi-pref. (JP)

(72) Inventor: Hidetoshi Ooiwa, Anjo (JP)

(73) Assignee: DENSO CORPORATION, Kariya (JP)

( * ) Notice: Subject to any disclaimer, the term of this patent is extended or adjusted under 35 U.S.C. 154(b) by 104 days.

(21) Appl. No.: 14/728,371

(22) Filed: Jun. 2, 2015

(65) Prior Publication Data

US 2015/0345411 A1 Dec. 3, 2015

(30) Foreign Application Priority Data

Jun. 3, 2014 (JP) ..... 2014-114686

(51) Int. Cl.
*F02D 41/00* (2006.01)
*F02M 25/08* (2006.01)

(52) U.S. Cl.
CPC .... *F02D 41/004* (2013.01); *F02D 2200/0406* (2013.01); *F02M 25/089* (2013.01); *F02M 25/0836* (2013.01)

(58) Field of Classification Search
CPC ..... F02M 25/0836; F02M 25/089; F02M 25/0854; F02M 25/0872; F02M 25/0809; F02M 25/08; F02M 25/0818; F02M 2025/0881; F02D 41/004; F02D 41/0032; F02D 41/0042; B60K 2015/03514
USPC ..... 123/516, 518, 519
See application file for complete search history.

(56) References Cited

U.S. PATENT DOCUMENTS 5,918,580 A * 7/1999 Hennrich ..... F02M 25/089 123/516
5,975,062 A * 11/1999 Bonse ..... F02M 25/0818 123/519
6,014,958 A * 1/2000 Miwa ..... F02D 41/0032 123/516
6,196,202 B1 * 3/2001 Busato ..... F02M 25/089 123/198 D
6,389,882 B1 * 5/2002 Ohkuma ..... F02M 25/0818 73/114.39
6,769,418 B1 * 8/2004 Reddy ..... F02D 41/0035 123/179.14

(Continued)

FOREIGN PATENT DOCUMENTS

JP 7-77118 3/1995
JP 3589632 11/2004

(Continued)

*Primary Examiner* — Sizo Vilakazi
(74) *Attorney, Agent, or Firm* — Nixon & Vanderhye P.C.

(57) ABSTRACT

In an evaporation fuel processing apparatus, a canister holds an evaporation fuel evaporated in a fuel tank, a purge passage communicates with the canister and an intake passage of an engine, a purge pump disposed in the purge passage pressurizes and feeds an air in the canister toward the intake passage, a bypass passage disposed in the purge passage bypasses the purge pump, and an on-off valve disposed in the purge passage opens and closes the bypass passage. When an intake negative pressure of the intake passage is low, the purge pump is activated, and the bypass passage is closed by the on-off valve. When the intake negative pressure of the intake passage is not low, the purge pump is stopped, and the bypass passage is open by the on-off valve.

4 Claims, 1 Drawing Sheet

(56) References Cited

U.S. PATENT DOCUMENTS 7,536,251 B2 * 5/2009 Saito ..... B60W 10/26 123/480
7,966,996 B1 * 6/2011 Pursifull ..... F02B 37/127 123/198 C
2002/0121270 A1 * 9/2002 Kano ..... F02M 25/08 123/520
2002/0139173 A1 * 10/2002 Kano ..... F02M 25/089 73/49.7
2002/0162457 A1 * 11/2002 Hyodo ..... F02M 25/089 96/109
2003/0131655 A1 * 7/2003 Miyahara ..... F02M 25/0818 73/37
2003/0196645 A1 * 10/2003 Kojima ..... F02M 25/089 123/520
2003/0226549 A1 * 12/2003 Takagi ..... F02M 25/0818 123/520
2005/0011185 A1 * 1/2005 Annoura ..... F02D 41/0032 60/289
2006/0278201 A1 * 12/2006 Nakamura ..... F02M 25/0818 123/519
2012/0130596 A1 * 5/2012 Ooiwa ..... B60K 15/03519 701/45
2012/0132179 A1 * 5/2012 Kobayashi ..... F02M 25/0818 123/518
2013/0008414 A1 * 1/2013 Matsunaga ..... F02M 25/0836 123/519
2014/0026867 A1 * 1/2014 Itoh ..... F02M 25/0854 123/520
2014/0096749 A1 * 4/2014 Pearce ..... F02D 41/004 123/520
2014/0119957 A1 5/2014 Yamanaka et al.
2015/0159597 A1 * 6/2015 Woods ..... F02M 25/089 123/495
2015/0285170 A1 * 10/2015 Nanba ..... F02D 41/004 123/520
2016/0123280 A1 * 5/2016 Makino ..... F02M 25/089 123/519
2016/0177883 A1 * 6/2016 Matsunaga ..... F02M 25/0836 123/519

FOREIGN PATENT DOCUMENTS

JP 4807296 11/2011
JP 2014-181681 9/2014
JP 2015-94329 5/2015

* cited by examiner

EVAPORATION FUEL PROCESSING APPARATUS

CROSS REFERENCE TO RELATED APPLICATION

This application is based on Japanese Patent Application No. 2014-114686 filed on Jun. 3, 2014, the disclosure of which is incorporated herein by reference.

TECHNICAL FIELD

The present disclosure relates to an evaporation fuel processing apparatus which introduces an evaporation fuel (vapor gas) held in a canister to an intake passage and executes a purge operation.

BACKGROUND

Recently, it is a tendency that an intake negative pressure becomes lower according to a request of a low emission quantity of an engine, a request of a low rotation speed, and a request of an energy saving by utilizing a supercharger. When the intake negative pressure is low, a purge quantity of the evaporation fuel introduced from the canister 2 to the intake passage 3 is reduced, and a purge operation is deteriorated.

According to Japanese Patent No. 4807296, a purge pump 7 is provided in the purge passage 5. The evaporation fuel held in the canister 2 is pressurized and fed to the intake passage 3 according to an operation of the purge pump 7.

SUMMARY

The present disclosure is made in view of the above matters, and it is an object of the present disclosure to provide an evaporation fuel processing apparatus in which an operation frequency of a purge pump is reduced and the purge pump that is stopped does not disturb a purge operation of an evaporation fuel.

According to an aspect of the present disclosure, the evaporation fuel processing apparatus includes a canister, a purge passage, a purge pump, a bypass passage, and an on-off valve. The canister holds an evaporation fuel evaporated in a fuel tank. The purge passage communicates with the canister and an intake passage of an engine. The purge pump is disposed in the purge passage, and the purge pump pressurizes and feeds an air in the canister toward the intake passage. The bypass passage is disposed in the purge passage, and the bypass passage bypasses the purge pump. The on-off valve is disposed in the purge passage, and the on-off valve opens and closes the bypass passage. When an intake negative pressure of the intake passage is low, the purge pump is activated, and the bypass passage is closed by the on-off valve. When the intake negative pressure of the intake passage is not low, the purge pump is stopped, and the bypass passage is open by the on-off valve.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
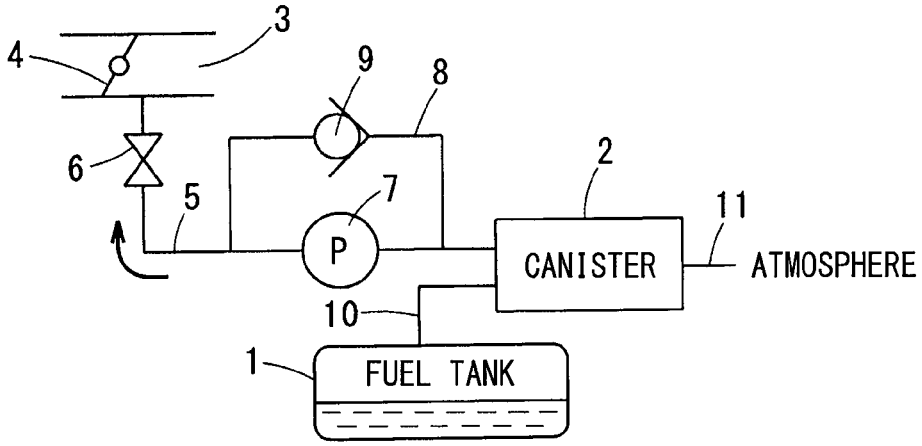
FIG. 1 is a schematic diagram showing an outline of an evaporation fuel processing apparatus according to an embodiment of the present disclosure.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

[Embodiment]

Figure 2:
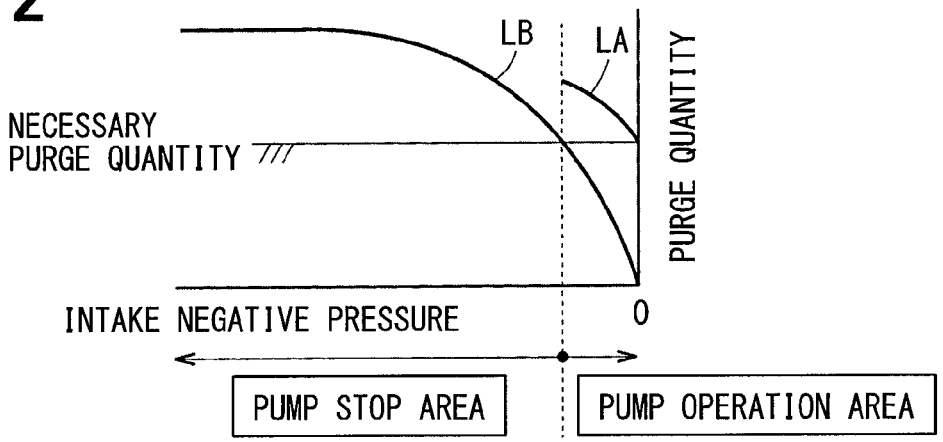
FIG. 2 is a graph showing a relationship between an intake negative pressure and a purge quantity according to the embodiment.

Referring to FIGS. 1 and 2, an embodiment of the present disclosure will be described.

An evaporation fuel processing apparatus is applied to a vehicle mounted with an engine such as a hybrid vehicle, a vehicle having an idle reduction function, or a vehicle mounted with a conventional engine. The evaporation fuel processing apparatus holds an evaporation fuel of the fuel tank 1 in a canister 2. When the engine is operating, the evaporation fuel processing apparatus executes a purge operation introducing the evaporation fuel held in the canister 2 to an intake passage 3 of the engine.

The evaporation fuel processing apparatus includes the canister 2, a purge passage 5, a purge valve 6, a purge pump 7, a bypass passage 8, and an on-off valve 9.

The canister holds the evaporation fuel that is evaporated in the fuel tank 1.

The purge passage 5 introduces the evaporation fuel held in the canister 2 to a negative-pressure generating area of the intake passage 3. According to the present embodiment, the negative-pressure generating area is an area downstream of a throttle valve 4.

The purge valve 6 adjusts an opening degree of the purge passage 5.

The purge pump 7 is provided in the purge passage 5 between the purge valve 6 and the canister 2. The purge pump 7 pressurizes and feeds an air in the canister toward the intake passage 3. In this case, the air indicates an air included in the evaporation fuel.

The bypass passage 8 is provided in a midway position of the purge passage 5 to bypass the purge pump 7.

The on-off valve 9 opens and closes the bypass passage 8.

In addition, when the above elements of the evaporation fuel processing apparatus are electric components, the elements are controlled to be energized by a control device. The control device is referred to as an ECU executing an engine control. According to the present embodiment, the engine control is an operation control of the engine.

The canister 2 is a container receiving an absorbent material absorbing and holding the evaporation fuel in the canister 2. According to the present embodiment, the absorbent material may be an activated carbon. The canister 2 is connected to the negative-pressure generating area of the intake passage 3 through the purge passage 5.

The canister 2 is connected to a breather passage 10 introducing the evaporation fuel in the fuel tank 1 to the canister 2, such that the canister 2 communicates with an upper area of the fuel tank 1. In addition, a connection part between the breather passage 10 and the fuel tank 1 is provided with a vent valve, a roll-over valve, and a cut-off valve which are well known. When a pressure in the fuel tank 1 is greater than a pressure in a breather pipe, the vent valve is open. When the vehicle is accelerated or the vehicle overturns, the roll-over valve is closed to interrupt a communication state between the vent valve and the fuel tank 1. The cut-off valve is arranged in parallel with the roll-over valve. When a fuel level is increased by the roll-over valve, the cut-off valve interrupts the communication state between the vent valve and the fuel tank 1.

The canister 2 is connected to an atmosphere introducing passage 11, such that an air can be introduced into the canister 2 through the atmosphere introducing passage 11. The atmosphere introducing passage 11 is provided with a canister control valve (CCV) including an electromagnetic valve. The CCV is controlled by the ECU. When the CCV is open, the air is introduced into the canister 2.

The purge valve 6 is an electromagnetic valve of a normally closed (N/C) type which is well known. Specifically, when the purge valve 6 is energized, the purge valve 6 is open. The purge valve 6 is controlled by the ECU. When the engine is stopped, the purge valve 6 is deenergized and is closed. When the engine is operating, the purge valve 6 is energized to adjust a purge quantity introduced to the intake passage 3. In this case, the purge valve 6 may be energized by utilizing a duty ratio control. According to the present embodiment, the purge quantity is a gas quantity including a quantity of the evaporation fuel introduced to the intake passage 3.

The purge pump 7 is an electric pump including an electric motor and a pump. The pump of the purge pump 7 is not limited. For example, the pump of the purge pump 7 may be a vane pump or a Wesco pump.

The purge pump 7 is controlled by the ECU. When an intake negative pressure is low (e.g., the intake negative pressure is lower than a determination value that is previously established), the purge pump 7 is activated. According to the present embodiment, the intake negative pressure is a negative pressure in the intake passage 3. In addition, the purge pump 7 may be controlled by an on-off control according to the ECU. Alternatively, a rotational speed (i.e., a pressurizing and feeding quantity of the air including the evaporation fuel) of the purge pump 7 may be controlled.

According to the present embodiment, the purge pump 7 is controlled by the on-off control according to the ECU. Only when the intake negative pressure is low, the purge pump 7 is activated.

When the ECU determines that the intake negative pressure in the area downstream of the throttle valve 4 is lower than the determination value, the ECU turns on the purge pump 7. In this case, the intake negative pressure is in a pump operation area. When the ECU determines that the intake negative pressure in the area downstream of the throttle valve 4 is higher than or equal to the determination value, the ECU turns off the purge pump 7. In this case, the intake negative pressure is in a pump stop area. In addition, an operation boundary between the pump operation area and the pump stop area is provided with a hysteresis as a preventing portion preventing a hunting of an on-off operation of the purge pump 7.

The intake negative pressure that is used as a determination standard of the ECU may be calculated or estimated based on information obtained by the ECU. In this case, the information may be an engine speed and a throttle opening degree. Alternatively, the intake negative pressure may be detected by a sensor.

The bypass passage 8 is a communication passage communicating an inlet of the purge pump 7 and an outlet of the purge pump 7. The bypass passage 8 may be integrally bonded to a housing of the purge pump 7. Alternatively, the bypass passage 8 may be formed by a pipe independent from the purge pump 7.

The on-off valve 9 is a valve opening and closing the bypass passage 8. When the intake negative pressure is low, the on-off valve 9 is closed. When the intake negative pressure is not low, the on-off valve 9 is open. In other words, when the purge pump 7 is activated, the on-off valve 9 closes the bypass passage 8. When the purge pump 7 is stopped, the on-off valve 9 opens the bypass passage 8.

The on-off valve 9 may be a check valve being open and closed according to a difference between a pressure in the intake passage 3 and a pressure in the canister 2. Alternatively, the on-off valve 9 may be an electric valve switching between an open state of the on-off valve 9 and a closed state of the on-off valve 9 according to an energization state of the on-off valve 9.

When the on-off valve 9 is the check valve, an operation of the on-off valve 9 will be described.

When the pressure in the intake passage 3 is less than the pressure in the canister 2, the check valve is a mechanical valve which is open according to the difference between the pressure in the intake passage 3 and the pressure in the canister 2. For example, the check valve is a reed valve including a diaphragm or is a ball valve.

When the purge pump 7 is activated, the pressure in the intake passage 3 becomes greater than the pressure in the canister 2 according to a discharge pressure of the purge pump 7, and the check valve closes the bypass passage 8. When the purge pump 7 is stopped, the pressure in the intake passage 3 becomes less than the pressure in the canister 2, and the check valve opens the bypass passage 8.

When the on-off valve 9 is the electric valve, an operation of the on-off valve 9 will be described.

The electric valve may be the N/C type that is open of when being energized. Alternatively, the electric valve may be a normally open (N/O) type that is closed when being energized. The electric valve is controlled to be energized by the ECU. When the purge pump 7 is activated, the electric valve closes the bypass passage 8. When the purge pump 7 is stopped, the electric valve opens the bypass passage 8.

As shown in FIG. 2, a solid line LA indicates a relationship between the intake negative pressure and the purge quantity in a case where the purge pump 7 is turned on and the on-off valve 9 is closed. Further, a solid line LB indicated a relationship between the intake negative pressure and the purge quantity in a case where the purge pump 7 is turned off and the on-off valve 9 is open.

As the solid line LA shown in FIG. 2, a pumping capacity of the purge pump 7 is provided to ensure a necessary purge quantity in a case where the purge pump 7 is turned on. Specifically, even when the intake negative pressure is zero, the necessary purge quantity is ensured. According to the present embodiment, the necessary purge quantity is a lower limit of the purge quantity necessary to execute the purge operation. Further, as the solid line LA shown in FIG. 2, the purge quantity of when the purge pump 7 is turned on increases in accordance with an increase in intake negative pressure according to an effect of the intake negative pressure.

The ECU executes an operation control of the engine and an energization control of the electric components of the evaporation fuel processing apparatus. According to the present embodiment, the operation control includes an injection control of the fuel executed by the energization control of plural injectors.

When the engine is operating, the ECU adjusts an opening degree of the purge valve 6, adjusts the purge quantity (i.e., the evaporation fuel) introduced to the intake passage 3, and calculates an injection correction value based on the purge quantity. The ECU corrects an injection quantity of the fuel injected from the injectors by utilizing the injection correction value, such that an air-fuel ratio is maintained to a target air-fuel ratio that corresponds to an operation state of the engine. In addition, since an opening degree control of the purge valve 6 and an injection correction control according to the evaporation fuel are well known in a conventional technology, the description of the opening degree control and the injection correction control is omitted.

Figure 3:
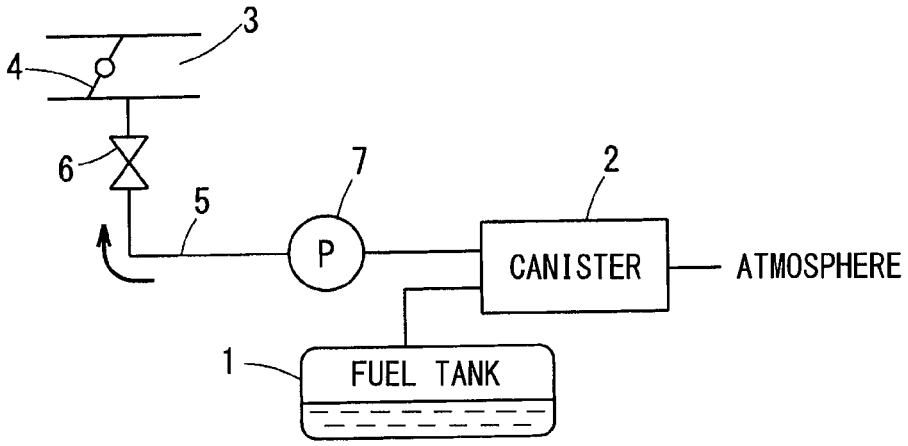
FIG. 3 is a schematic diagram showing an outline of an evaporation fuel processing apparatus according to a comparison example.

Referring to FIG. 3, an evaporation fuel processing apparatus according to a conventional technology will be described.

The evaporation fuel processing apparatus includes a canister 2, a purge passage 5, and a purge valve 6. The canister 2 holds an evaporation fuel evaporated in a fuel tank 1. The purge passage 5 introduces the evaporation fuel held in the canister 2 to a negative-pressure generating area of an intake passage 3. In this case, the negative-pressure generating area is an area downstream of a throttle valve 4. The purge valve 6 adjusts an opening degree of the purge passage 5.

Recently, it is a tendency that an operation frequency of the engine is reduced so as to achieve the energy saving or a reduction of $CO_2$, in a hybrid vehicle or a vehicle provided with an idle reduction function. Thus, when the engine is operating, it is preferable that the evaporation fuel held in the canister 2 is always introduced to the intake passage 3. Then, when the engine is operating, the purge pump 7 is always activated.

Further, a long life and high durability performance of the purge pump 7 is preferable, and then a cost of the purge pump 7 is increased and an electric consumption quantity is increased.

When the intake negative pressure is not low, it is possible that the purge pump 7 is stopped and the evaporation fuel is introduced to the intake passage 3 according to the intake negative pressure.

However, when the purge pump 7 is stopped, the purge pump 7 functions as a resistance, and the purge operation of the evaporation fuel is disturbed by the purge pump 7 that is stopped.

According to the above embodiment, the evaporation fuel processing apparatus activates the purge pump 7 to execute the purge operation in the pump operation area where the intake negative pressure is low, and terminates the purge pump 7 in the pump stop area where the intake negative pressure is not low so as to open the bypass passage 8 to execute the purge operation. In other words, the evaporation fuel processing apparatus controls an activation of the purge pump 7 according to the intake negative pressure. Thus, an operation frequency of the purge pump 7 can be reduced, and a durability performance of the purge pump 7 can be deteriorated.

Thus, even though the durability performance of the purge pump 7 is deteriorated, a sufficient life of the purge pump 7 that is necessary can be achieved. In other words, a cost of the purge pump 7 is suppressed and the evaporation fuel processing apparatus with a long life can be provided.

According to the above embodiment, in the evaporation fuel processing apparatus, since the operation frequency of the purge pump 7 can be reduced, an electric-power consumption quantity of the purge pump 7 can be suppressed. Thus, an energy saving can be achieved, and a power generating load and a battery load of a power generating system mounted to the vehicle can be reduced.

According to the above embodiment, since the evaporation fuel processing apparatus executes the purge operation through the bypass passage 8 when the purge pump 7 is stopped, the necessary purge quantity can be ensured according to the intake negative pressure generated in the intake passage 3 without being affected by a resistance of the purge pump 7.

In other words, even though the evaporation fuel processing apparatus terminates the purge pump 7 when the intake negative pressure is not low, the purge pump 7 which is stopped does not disturb the purge operation.

According to the above embodiment, the ECU executing the engine control controls the evaporation fuel processing apparatus. However, it is not limited. For example, a control device independent from the ECU may control the evaporation fuel processing apparatus.

While the present disclosure has been described with reference to the embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An evaporation fuel processing apparatus comprising:

a canister holding an evaporation fuel evaporated in a fuel tank;

a purge passage communicating with the canister and an intake passage of an engine;

a purge pump disposed in the purge passage, the purge pump pressurizing and feeding an air in the canister toward the intake passage and the purge pump being an electric pump including an electric motor and a pump;

a bypass passage disposed in the purge passage, the bypass passage bypassing the purge pump;

an on-off valve disposed in the purge passage, the on-off valve opening and closing the bypass passage; and an engine control unit for executing engine control; wherein when an intake negative pressure of the intake passage is lower than a determination value that is previously established, the purge pump is activated, and the bypass passage is closed by the on-off valve, when the intake negative pressure of the intake passage is higher than or equal to the determination value, the purge pump is stopped, and the bypass passage is open by the on-off valve; and the purge pump is controlled to be turned on and turned off according to the engine control unit executing engine control;

when the engine control unit determines that the intake negative pressure in an area downstream of the throttle valve arranged in the intake passage is in a pump operation area where the intake negative pressure is lower than the determination value, the engine control unit turns on the purge pump;

when the engine control unit determines that the intake negative pressure in the area downstream of the throttle valve is in a pump stop area where the intake negative pressure is high than or equal to the determination value, the engine control unit turns off the purge pump; and an operation boundary between the pump operation area and the pump stop area is provided with a hysteresis preventing a hunting of the purge pump.

2. The evaporation fuel processing apparatus according to claim 1, wherein the on-off valve is a check valve being open and closed according to a difference between a pressure in the intake passage and a pressure in the canister.

3. The evaporation fuel processing apparatus according to claim 1, wherein the on-off valve is an electric valve switching between an open state of the on-off valve and a closed state of the on-off valve according to an energization state of the on-off valve.

4. The evaporation fuel processing apparatus according to claim 1, further comprising:

a purge valve disposed in the purge passage, the purge valve adjusting an opening degree of the purge passage, wherein the purge valve and the purge pump are controlled to be energized by an ECU executing an operation control of the engine.

* * * * *